US005411461A

United States Patent [19]

Thomascik

[11] Patent Number: 5,411,461

[45] Date of Patent: May 2, 1995

[54] SKIJOR BELT

[76] Inventor: Terrance A. Thomascik, P.O. Box 308, Chugiak, Ak. 99567

[21] Appl. No.: 44,580

[22] Filed: Apr. 6, 1993

[51] Int. Cl.[6] ..... A63B 21/02

[52] U.S. Cl. ..... 482/124; 482/74; 482/126; 280/1.5; 280/290; 280/809

[58] Field of Search ..... 482/74, 124, 126, 43, 482/69; 280/809, 24, 290, 288.4, 1.5

[56] References Cited

U.S. PATENT DOCUMENTS

| | | | |
|---|---|---|---|
| 4,073,490 | 2/1978 | Feather | 482/69 |
| 4,396,013 | 8/1983 | Hasslinger | 482/74 |
| 4,441,707 | 4/1984 | Bosch | 482/131 |

*Primary Examiner*—Stephen R. Crow
*Assistant Examiner*—Lynne A. Reichard

[57] ABSTRACT

An exercise belt which is worn around the waist or hips of the user having an outer band of neoprene (10) which expands and contracts with the pulling and releasing of the belt. A continuous band of webbing (12) with expansion loops (14) and web loops (16), is attached to the outer band of neoprene (10). The expansion loops limit the neoprene (10) from over expanding. The web loops (16) allow for connecting to a tow line. A patch of velcro pile (18) at the rear of the belt allows accessories to be attached. An inner band of neoprene (10) with velcro (18 & 20) assists in a firm fit, and adjusts for various user sizes. The belt is characterized as quick and easy to put on and take off.

10 Claims, 1 Drawing Sheet

SKIJOR BELT

BACKGROUND—FIELD OF INVENTION

This invention is an exercise belt, specifically to belts which are pulled while walking, jogging, running, or skiing. This invention produces a smoother transition from stationary motion and also provides the wearer a more comfortable connection for long periods of time. In Scandinavian and European countries skijoring and skipulk are popular sports. Skijoring occurs when a skier is pulled by one or two dogs. Skipulk occurs when dogs pull a small sled "pulk" with the skier attached behind the "pulk".

BACKGROUND—DESCRIPTION OF PRIOR ART

Three belts are being used in walking, running, jogging, and skiing while being pulled: climbing harnesses, backpad belts, and european skijot belts.

The disadvantages of these types are:

(a) Do not expand and contract to even out the uneven pulling-all three.

(b) Fasten only around the users waist-all three.

(c) Cumbersome to put on and off-climbing harness.

OBJECTS AND ADVANTAGES

The object and the advantages of the present invention are:

(a) Expands and contracts for smooth pulling transitions.

(b) Is easier on a users back.

(c) Can be worn around the waist or the hips.

(d) Adjusts to fit firmly to the users waist or hips.

(e) Is easy to put on and take off.

(f) Includes safety features such as reflective material, quick release loops, and velcro patches for accessories.

DRAWING FIGURES

Reference Numerals In Drawings

| | |
|---|---|
| 10 neoprene | 12 webbing |
| 14 web expansion loop | 16 web loop |
| 18 velcro pile | 20 velcro hook |
| 22 buckle | 24 reflective material |

DESCRIPTION—FIGS. 1 TO 6

Figure 1:
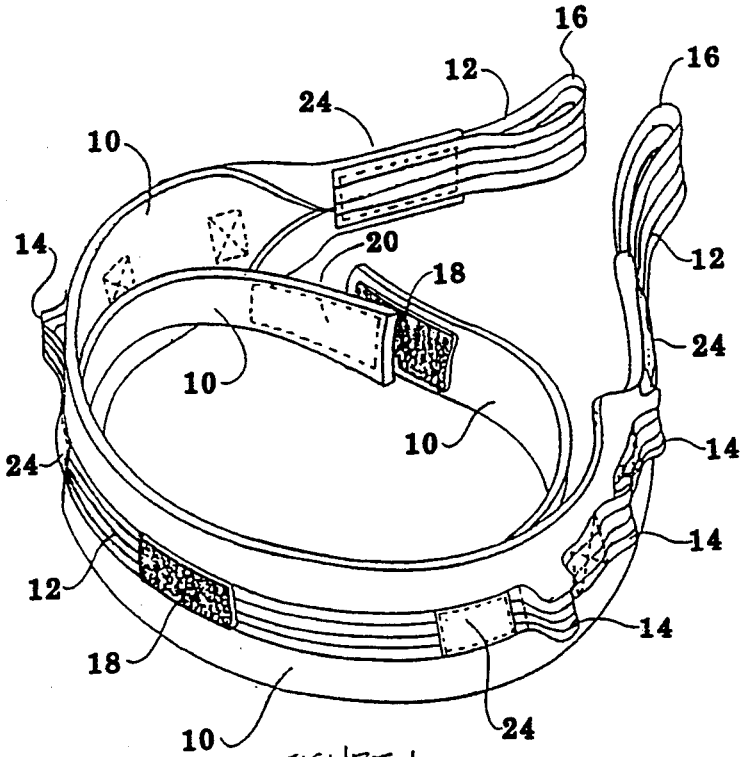
FIG. 1 shows a perspective view.

FIG. 1 shows a typical embodiment of the skijoring belt, shaped for encircling the waist or hips of the user, with the inner band which holds the outer band firmly in place. A tow line or lead line attaches at the web loops (16) so the user can be connected to the pulling force, e.g. dogs. The outer band of neoprene (10) expands and contracts as pulling occurs. A continuous band of webbing (12) from the front loop (16) around the belt to the other front loop (16) provides structural integrity to the design. The webbing (12) is sewn and glued to the neoprene (10) at various places. Expansion loops (14) allow for the neoprene (10) to expand as far as possible but not so far as to rip or tear. Reflective material (24) is sewn on for night use. Velcro pile (18) and velcro hook (20) allow for a quick closure of the inner band, and easily adjusts for various size users. A rear velcro pile (18) allows for the attachment of various small articles having velcro hooks (20).

Figure 2:
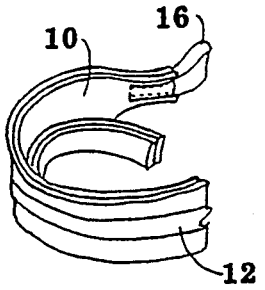
FIG. 2 shows a detail of the doubled neoprene.

FIG. 2 shows a belt with two layers of neoprene (10) for both the inner and outer bands for heavy duty use.

Figure 3:
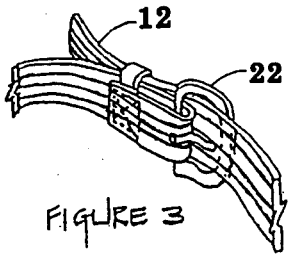
FIG. 3 shows the buckle option.

FIG. 3 is an optional inner band of webbing (12) and a buckle (22).

Figure 4:
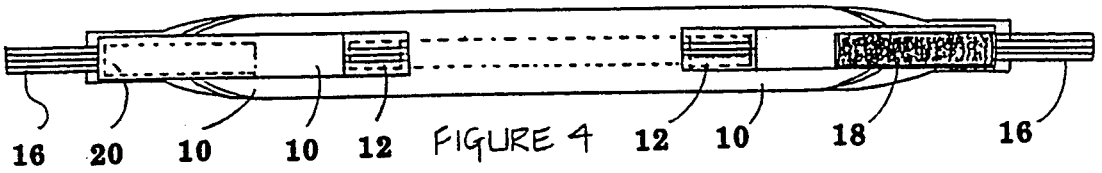
FIG. 4 shows the inside elevation.

FIG. 4 is an inside view of the skijoring belt.

Figure 5:
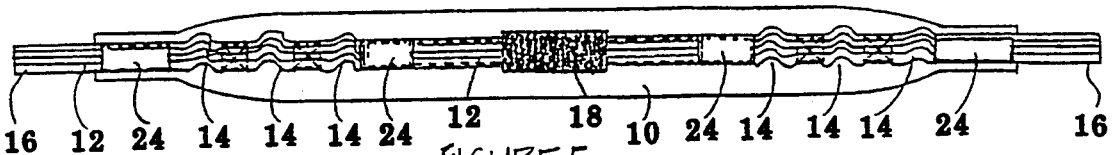
FIG. 5 shows the outside elevation.

FIG. 5 is an outer view showing a rear velcro pile (18) patch for attaching small items to the rear of the belt., reflective material (24) for night safety and the expansion loops (14) to protect the neoprene (10) from stretching so far as to rip or tear.

Figure 6:
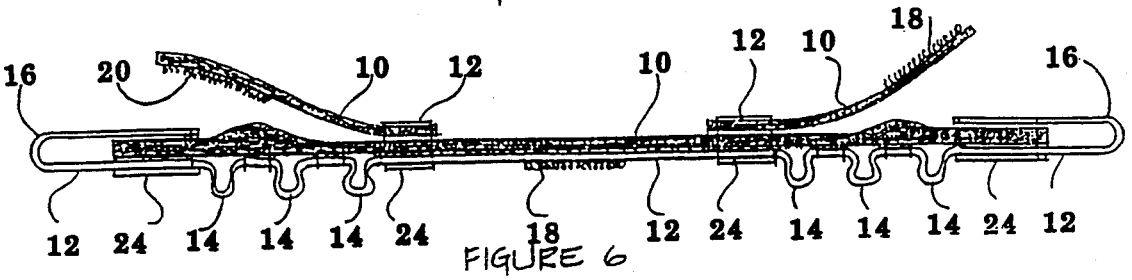
FIG. 6 shows the plan view.

FIG. 6 shows a plan view. Notice on the inner band of neoprene (10) that webbing (12) is used to strengthen the fastening of the inner bands of neoprene (10) to the outer band of neoprene (10) and to the continuous band of webbing (12) on the outer band.

OPERATION—FIG. 1

The manner of using the skijoring belt is to place the belt around the waist or hips of the user and fasten it by pulling the inner bands of neoprene (10) so as to overlap each other and pressing the velcro pile (18) and velcro hook (20) together. The tow line can then be attached with a carabiner at the web loops (16). As the user is pulled, the neoprene (10) expands allowing for a smoother pull as inertial forces are overcome. The expansion loops (14) limit how far the neoprene (10) can stretch. As the mount of pull decreases the neoprene (10) helps keep the line taught by constricting from its stretched position. To remove the belt, the tow line is disconnected from the web loops (16) and the inner band of neoprene (10) is unfastened.

SUMMARY, RAMIFICATION, AND SCOPE

Accordingly, one can see the advantages in this simple idea:

(a) Less stress on the back due to the expansion and contraction.

(b) Ability to wear it on the waist or hips.

(c) Smoother pulling and release.

(d) A firm and snug fit, adjusting to the individual user.

Although the description above contains many specifications, these should not be construed as limiting the scope of the invention but merely as providing illustrations of some of the presently preferred embodiments of this invention. For example—the inner band of neoprene (10) can be replaced by an inner webbing (12) with a buckle (22).

Thus, the scope of the invention should be determined by the appended claims and their legal equivalents, rather than by the examples given.

I claim:

1. A user worn pulling force dispersing device for skijorers, persons jogging with dogs, victims being rescued by towing, comprising;

an inner band of stretchable material sufficiently long to encircle the user, sufficiently wide not to cut into the user when being pulled and having two ends which by a fastening means closes said inner band, an outer band of stretchable material encircling the user and attached to said inner band opposite said ends, a stretching limitation means comprising a band of relatively inelastic material sufficiently long to extend the entire length of said outer band and to form a loop extending beyond each end of said outer band and a plurality of loops on either side of the portion of said outer band which is not attached to said inner band, said stretching limitation means attached to said outer band along its full length except where it forms said plurality of loops extending beyond said outer band.

2. The device of claim 1 wherein said stretchable material is neoprene.

3. The device of claim 1 wherein said outer band is folded over itself for a short distance near said ends so as to narrow it's width or double its thickness.

4. The device of claim 1 wherein said fastening means comprises a hook and loop mated material fastening means attached to said inner band in sufficient length to permit closure about varying sized users.

5. The device of claim 1 wherein a strengthening means comprised of a double layer of said elastic material forms said outer band.

6. The device of claim 1 wherein said inner band is comprised of said relatively inelastic material.

7. The device of claim 1 wherein said outer band is comprised of said relatively inelastic material.

8. The device of claim 1 wherein said fastening means comprises a hook and loop fastening means attached to said relatively inelastic material to permit attachment of accessories.

9. The device of claim 1 further including reflective material attached to said outer band.

10. The device of claim 9 further including said reflective material attached to said relatively inelastic material attached to said outer band.

* * * * *